United States Patent [19]

Ando

[11] Patent Number: 4,655,907

[45] Date of Patent: Apr. 7, 1987

[54] TENSIONING APPARATUS FOR A WIRE NET IN A VIBRATION SIEVING MACHINE

[75] Inventor: Seiya Ando, Mitaka, Japan

[73] Assignee: Kabushiki Kaisha Ando Screen Seisakusho, Tokyo, Japan

[21] Appl. No.: 702,143

[22] Filed: Feb. 15, 1985

[30] Foreign Application Priority Data

Jul. 31, 1984 [JP] Japan ..... 59-117338[U]

[51] Int. Cl.[4] ..... B07B 1/49; B21F 33/00

[52] U.S. Cl. ..... 209/404; 209/402; 209/405; 209/412; 140/109

[58] Field of Search ..... 209/381, 383, 400–403, 209/405, 399, 395, 394, 391, 392, 313, 357, 346–349, 404, 310, 408, 412, 413, 382; 52/222; 160/378, 328, 395; 101/128.1, 127.1, 415.1; 38/102.1; 210/232; 55/409

[56] References Cited

U.S. PATENT DOCUMENTS

| | | | |
|---|---|---|---|
| 1,839,614 | 1/1932 | Symons | 209/403 |
| 1,839,615 | 1/1932 | Symons | 209/310 |
| 1,906,336 | 5/1933 | Reynolds | 209/347 |
| 2,279,042 | 4/1942 | Harrington | 209/403 |
| 3,119,331 | 1/1964 | Koch et al. | 101/415.1 |
| 3,139,400 | 6/1964 | Kyle | 209/403 |
| 3,391,635 | 7/1968 | Matheus | 101/127.1 |
| 3,469,695 | 9/1969 | Greeninger | 209/403 |
| 3,655,045 | 4/1972 | McAllister | 209/379 |
| 3,968,033 | 7/1976 | Illemann et al. | 209/403 |
| 4,319,992 | 3/1982 | Davis et al. | 209/275 |

*Primary Examiner*—S. Leon Bashore
*Assistant Examiner*—Thomas M. Lithgow
*Attorney, Agent, or Firm*—Price, Heneveld, Cooper, DeWitt & Litton

[57] ABSTRACT

One end portion of a wire net is fixedly secured to a fixed holder on a base frame of a sieving machine provided with a vibration device, the other end portion thereof is fixedly secured to a movable holder that is provided on the base frame so as to be freely movable, this movable holder is biased in the direction of separating the movable holder from the fixed holder by means of a spring provided on the base frame, and also, on the base frame is provided a hydraulic device which moves the movable holder in the direction of approaching to the fixed holder against the resilient force of the spring. During operation of this sieving machine, in orer to clear blocking of the meshes of the wire net, the hydraulic device is actuated only when the particles of raw material which caused the blocking are shaken off by relaxing the wire net and broadening the distance between adjacent wires in the wire net. Thereby, power consumption of the hydraulic device can be greatly saved as compared to a similar type of tensioning apparatus for a wire net in a vibration sieving machine in the prior art.

3 Claims, 4 Drawing Figures

TENSIONING APPARATUS FOR A WIRE NET IN A VIBRATION SIEVING MACHINE

BACKGROUND OF THE INVENTION

The present invention relates to a tensioning apparatus for a wire net in a vibration sieving machine that is available for sieving of pulverized or granular materials such as agricultural products, minerals or the like.

Heretofore, in such type of machines generally used in the prior art, wire nets are mounted on a frame provided with a vibration device in a tensioned state. As to the method for mounting the wire nets on the frame, hooks are provided at the opposite ends of each wire net, hooks at one end of the wire net are engaged with latches provided on the frame, hooks at the other end of the wire net are engaged with other latches which are provided movably on the same frame, and the wire net is tensioned by pulling the latter movable latches in the direction opposite to the former fixed latches by means of a hydraulic device provided on the frame, which device consists of a piston, a cylinder and the like and makes use of a hydraulic pressure. Under the condition where the wire net has been tensioned in the above-described manner, the vibration device is operated while a raw material to be sieved is being fed onto the wire net, and thereby sieving of agricultural materials, minerals, or the like can be achieved.

If the above-mentioned sieving operation is continued over a long period of time, then in the wire net, blocking of the meshes of the net would be caused by the raw material, and hence the operation efficiency is lowered. In such a case, feeding of the raw material is stopped, and also the operation of the above-described hydraulic device which holds the wire net in a tensioned state, is interrupted. Then, the wire net which has been tensioned hitherto is relaxed at once, hence the distance between adjacent wires in the wire net is broadened, and since the vibration is still continued even under the relaxed state, particles of the pulverized or glanular material which caused the blocking of the wire net are shaken off. Once this shaking off operation has been finished, immediately the wire net is tensioned again by operating the above-described hydraulic device, the raw material is fed again, and thereby the sieving operation is recommenced. As described above, of the sieving machine in the prior art, blocking of the meshes of the wire net can be easily cleared, and so, the sieving machine has been widely used.

However, while the sieving machine of the prior art had the above-described excellent feature, on the other hand it has the following difficulty. That is, the difficulty exists in that as descibed above, during the operation of the sieving machine the hydraulic device must be always kept operating to hold the wire net in a tensioned state. To that end, hydraulic power for actuating the hydraulic device is continuously necessary during the operation of the sieving machine.

SUMMARY OF THE INVENTION

It is therefore one object of the present invention to provide a tensioning apparatus for a wire net in a vibration sieving machine in which consumption of power for tensioning a wire net during operation of a sieving machine can be eliminated.

Another object of the present invention is to provide the above-mentioned tensioning apparatus for a wire net in a vibration sieving machine in which the tension of the wire net can be arbitrarily adjusted.

According to one feature of the present invention which is most suitable for achieving the aforementioned objects, there is provided a tensioning apparatus for a wire net in a vibration sieving machine, which apparatus comprises a base frame supported for vibration, on a foundation by means of springs. A vibration device, a fixed holder and a movable holder are provided on the base frame so as to be freely movable, a wire net having its one end engaged with the fixed holder either directly or indirectly and the other end engaged with the movable holder either directly or indirectly, a spring disposed between the base frame and the movable holder so as to bias the movable holder in the direction of separating the movable holder from the fixed holder, and a hydraulic device provided on the base frame for moving the movable holder towards the fixed holder against the biasing force of the spring.

The above-mentioned and other features and objects of the present invention will be better understood from perusal of the following description of one preferred embodiment of the invention taken in conjunction with the accompanying drawings.

DESCRIPTION OF THE PREFERRED EMBODIMENT

Figure 1:
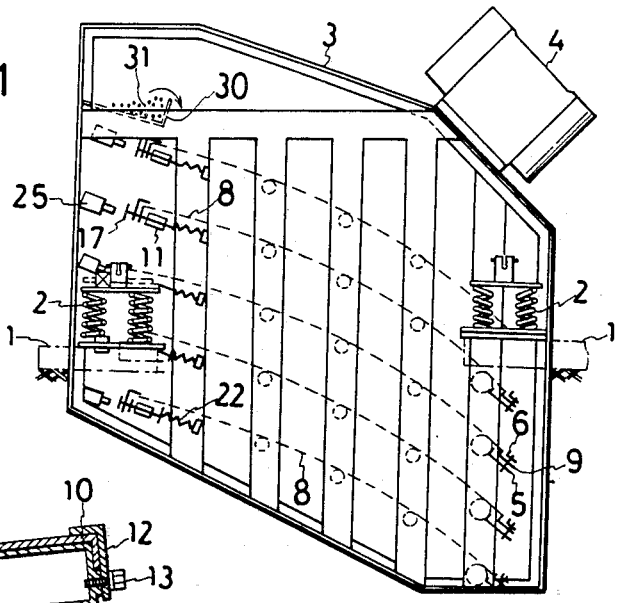
FIG. 1 is a schematic side view showing outline of one preferred embodiment of the present invention.
Figure 2:
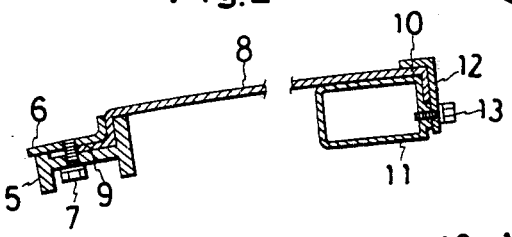
FIG. 2 is an enlarged vertical cross-section view showing a part of a tensioning apparatus for a wire net according to the present invention shown in FIG. 1.

In FIG. 1, reference numeral 1 designates a foundation, on which a base frame 3 is supported via springs 2 for vibration. Reference numeral 4 designates a vibration device disposed on the base frame 3, which device is supplied with electric power from a power supply not shown. In the vibration device is provided an electric motor having a weight mounted eccentrically on its shaft, hence the weight is revolved by rotating the shaft of the motor, and thereby continuous vibration can be generated. Reference numeral 5 designates a fixed holder provided on the base frame 3, and as shown in FIG. 2, one end portion 9 of a wire net 8 is adapted to be fixed on the fixed holder by means of a fixing piece 6 and fixing members 7.

While the fixed holder 5 directly holds the wire net 8 in the illustrated embodiment, this is merely one example of the possible holding structures, and the holding structure is not limited to the illustrated one. Besides, although illustration is omitted, the holding structure can be formed in such manner that one end portion 9 of the wire net 8 is preliminarily provided with a mounting member and this mounting member may be held by the fixed holder. The other end portion 10 of the wire net 8 is fixed on a movable holder 11 by means of a fixing piece 12 and a fixing member 13 as shown in FIG. 2. It is to be noted that although illustration is omitted, as a matter of course, modification could be made such that a mounting member is preliminarily provided at the other end portion 10 of the wire net 8 and this mounting member is held by the movable holder 11 similarly to the case of the above-described one end portion 9.

Figure 3:
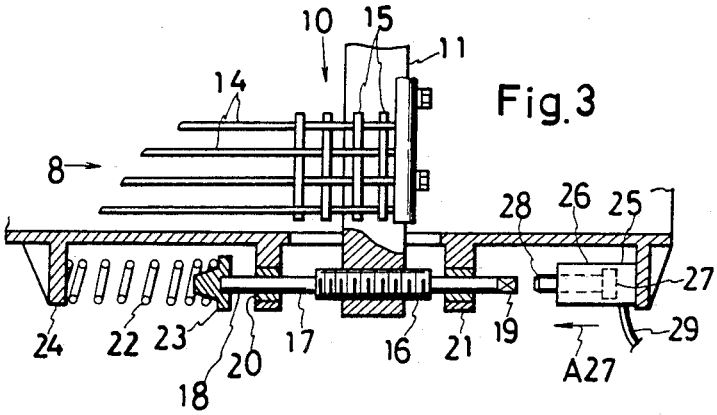
FIG. 3 is an enlarged horizontal cross-section view showing another part of the tensioning apparatus.

Regarding the above-described wire net 8, this is formed of a large number of metallic wires, especially steel wires disposed in the same direction at a constant interval as shown in FIG. 3, and it is one kind of net formed of wires 14 directed in the same direction. However, as shown at one end portion 10 in FIG. 3, at the opposite end portions 9 and 10 in the lengthwise direction of the wire net 8, a plurality of orthogonal wires 15 are provided as intersecting with the aforementioned wires 14 to form a conventional cross net.

Figure 4:
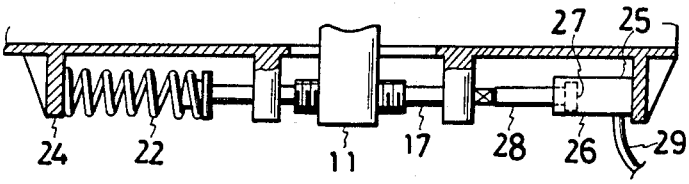
FIG. 4 is a similar enlarged horizontal cross-section view of the same part as that shown in FIG. 3 but under a different operating condition.

Referring now to FIGS. 3 and 4, the above-described movable holder 11 is threadedly mated with an adjusting shaft 17 having a screw portion 16, and the opposite end portions 18 and 19 of this adjusting shaft 17 are supported by bearings 20 and 21, respectively, provided on the base frame 3. In addition, a spring 22 provided on the base frame 3 is connected to one end of the adjusting screw 17 as shown in FIGS. 3 and 4, and with the aid of this spring 22, the adjusting shaft 17 and hence the above-described movable holder 11 are biased in the direction of separating from the fixed one end portion 9 of the wire net 8. In these figures, reference numeral 23 designates a flange, and reference numeral 24 designates a support for the spring 22.

Reference numeral 25 designates a hydraulic device consisting of a cylinder 26, a piston 27 and a piston rod 28, which device includes a passageway 29 for a fluid. This hydraulic device 25 is connected to a pressurizing device for a fluid not shown through the above-mentioned passageway 29. By actuating the pressurizing device, the piston 27 of the hydraulic device 25 is moved, and thereby the tip end of the piston rod 28 pushes the end portion 19 of the adjusting shaft 17 to push it. In the case where the piston rod 28 pushes the end portion 19 of the adjusting shaft 17 as described above, the adjusting shaft 17 is moved toward the fixed end portion of the wire net 8 against the resilient force of the spring 22, and consequently, the wire net 8 is relaxed. If the pushing operation of the piston rod 28 is stopped, then the adjusting shaft is moved in the direction of separating from the fixed end portion 9 of the wire net 8 by the resilient force of the spring 22, and hence the wire net 8 is tensioned.

By rotating the adjusting shaft 17 about its own axis, the position of the movable holder 11 can be moved relatively to the adjusting shaft 17 either in the direction of separating from the fixed end portion 9 or in the direction of approaching the fixed end portion 9.

Now description will be made of the operation of the above-described tensioning apparatus for a wire net in a vibration sieving machine according to the present invention. In operation, the base frame is subjected to vibration by actuating the vibrating device, and under such a vibrating condition, a raw material 31 is fed from a feeder 30 of the raw material to carry out sieving of the raw material 31. In this case, the wire net 8 is disposed between the fixed holder 5 and the movable holder 11, and since the movable holder 11 is biased in the direction of separating from the fixed holder 5 by the action of the spring 22, the wire net 8 is kept tensioned.

Subsequently, after operation of this vibration sieving machine over a long period of time, when blocking of the meshes of the wire net 8 has occurred, feeding of the raw material 31 is stopped and the piston 27 is pushed out in the direction of arrow A27 in FIG. 3 by actuating the hydraulic device 25. Then the adjusting shaft 17 is pushed and moved in the same direction against the resilient force of the spring 22, thereby the wire net 8 is relaxed, and the distance between the respective wires 14 is broadened. Even under such a relaxed condition, the base frame 3 and hence the wire net 8 are subjected to vibration, and consequently, the particles of the raw material 31 which caused the blocking of the meshes of the wire net 8 are shaken off. When this shake-off operation has been finished, the hydraulic device 25 is actuated in the reverse direction, and thereby the piston 26 is moved in the direction opposite to the direction of arrow A27. Then, the adjusting shaft 17 is pushed in the same direction by the resilient force of the spring 22, and consequently, the wire net 8 is again tensioned. After the wire net 8 has been tensioned, feeding of the raw material 31 is recommenced, and thus the sieving operation is started again.

Since the tensioning apparatus for a wire net in a vibration sieving machine according to the present invention is constructed as described above, it is necessary to actuate the hydraulic device 25 only when blocking of the meshes of the wire net 8 is to be cleared in distinction from the similar apparatus in the prior art as described previously, and during the other period in the operation of the sieving machine, the hydraulic device 25 is kept in a rest condition. Therefore, the power consumption of the hydraulic device 25 can be greatly reduced as compared to that of the similar tensioning apparatus for a wire net of a vibration sieving machine in the prior art.

Since many changes and modifications can be made to the above-described construction without departing from the spirit of the present invention, it is intended that all matter contained in the above description and illustrated in the accompanying drawings shall be interpreted to be illustrative and not as a limitation to the scope of the invention.

What is claimed is:

1. In a machine for sieving materials having a wire mesh screen and a base frame, means for supporting said screen, said means comprising: first and second screen anchor members secured to opposite ends of said screen and supported on said base frame; said first anchor member having support means for supporting it on said base frame including a shaft secured to said first anchor member and slideably mounted to said base frame for reciprocal sliding movement; a compression spring means having one end seated against said base frame and its other end seated against one end of said shaft for urging said first and second anchor members apart to tension said screen; a plunger and means to move said plunger mounted on said base frame and said plunger being substantially aligned with the other end of said shaft whereby upon activation of said means to move said plunger, said plunger will move and impact said other end of said shaft; compressing said spring and releasing the tension of said screen.

2. The machine for sieving materials described in claim 1 wherein the means to move said plunger is fluid operated.

3. The machine for sieving materials described in claim 1 wherein the support for said first anchor member includes an externally threaded collar rigidly secured to and surrounding said shaft, said collar extending through and threadedly engaging said first anchor member whereby the axial position of said shaft can be adjusted with respect to said first anchor member for adjusting the amount of tension applied to the screen by the spring.

* * * * *